US009412223B2

(12) United States Patent
Sumi

(10) Patent No.: US 9,412,223 B2
(45) Date of Patent: Aug. 9, 2016

(54) OPERATION UNIT AND GAME MACHINE

(71) Applicant: OMRON Corporation, Kyoto-shi, Kyoto (JP)

(72) Inventor: Masaaki Sumi, Gifu (JP)

(73) Assignee: OMRON Corporation, Kyoto (JP)

( * ) Notice: Subject to any disclaimer, the term of this patent is extended or adjusted under 35 U.S.C. 154(b) by 50 days.

(21) Appl. No.: 14/469,936

(22) Filed: Aug. 27, 2014

(65) Prior Publication Data

US 2015/0094148 A1 Apr. 2, 2015

(30) Foreign Application Priority Data

Sep. 30, 2013 (JP) ..... 2013-205593

(51) Int. Cl.
*A63F 9/24* (2006.01)
*G07F 17/32* (2006.01)

(52) U.S. Cl.
CPC ..... *G07F 17/3209* (2013.01)

(58) Field of Classification Search
None
See application file for complete search history.

(56) References Cited

U.S. PATENT DOCUMENTS 7,382,357 B2 * 6/2008 Panotopoulos et al. ..... 345/168
7,986,306 B2 * 7/2011 Eich et al. ..... 345/173
8,262,480 B2 * 9/2012 Cohen et al. ..... 463/37
8,310,349 B2 * 11/2012 Pfau et al. ..... 340/407.1
8,310,350 B2 * 11/2012 Pfau et al. ..... 340/407.1
8,488,069 B2 * 7/2013 Dimitrov et al. ..... 348/838
8,587,541 B2 * 11/2013 Ciesla et al. ..... 345/173
8,832,574 B2 * 9/2014 Ostergard et al. ..... 715/768
8,994,666 B2 * 3/2015 Karpfinger ..... 345/173
9,024,908 B2 * 5/2015 Sinclair ..... 345/174
9,170,658 B2 * 10/2015 Quek
9,182,869 B2 * 11/2015 Satou et al.
9,205,340 B2 * 12/2015 Sharma et al.
2005/0085292 A1 4/2005 Inamura
2009/0189871 A1 * 7/2009 Yoon et al. ..... 345/173
2010/0130280 A1 * 5/2010 Arezina et al. ..... 463/20
2011/0111852 A1 * 5/2011 Cohen et al. ..... 463/37

FOREIGN PATENT DOCUMENTS

JP 2005-111137 A 4/2005

* cited by examiner

*Primary Examiner* — Paul A D'Agostino
(74) *Attorney, Agent, or Firm* — Osha Liang LLP

(57) ABSTRACT

An operation unit has a touch panel that senses a press, and a button plate disposed above the touch panel, and having a plurality of push buttons, each of which protrudes on a side opposite to a side where the touch panel is disposed. The button plate is provided along a surface of the touch panel, and has a base section having apertures at respective positions where the plurality of push buttons are formed, top surface sections, each of which constitutes corresponding one of the plurality of push buttons and serves as an operation surface, and bending deformable sections, each of which connects, in a freely elastically deformable manner, a peripheral section of corresponding one of the top surface sections and an edge of corresponding one of the apertures formed in the base section.

5 Claims, 9 Drawing Sheets

OPERATION UNIT AND GAME MACHINE

CROSS-REFERENCE TO RELATED APPLICATIONS

This Nonprovisional application claims priority under 35 U.S.C. §119 to Japanese Patent Application No. 2013-205593 filed in Japan on Sep. 30, 2013, the entire contents of which are hereby incorporated by reference.

BACKGROUND

1. Technical Field

The present invention relates to an operation unit and a game machine including the operation unit.

2. Related Art

Conventionally, there has been a game machine so-called a slot machine. In the slot machine, a plurality of reels displaying a plurality of kinds of symbols are spun. Then, according matching of symbols and a kind of matched symbols that are displayed in a window at the time when the reels stop, a prize is determined. Depending on the prize determined and the number of bets, an award is given. In the slot machine, an operation to input the number of bets and an operation to start a spin of the reels are performed by use of an operation unit provided on a front surface of the slot machine.

Such a slot machine is installed in a game facility such as a casino. In the game facility, slot machines manufactured by not only one game machine maker but also various game machine makers are installed. Each game player selects a machine that suits his/her preference, from among slot machines manufactured by various makers, and plays a game. Accordingly, such a game facility installs slot machines popular to game players so as to ensure the game facility's superiority to other competing game facilities.

In response to demands from game facilities, game machine makers are making an effort at developing a slot machine that can appeal to game players. In such circumstances, an operation unit on a front surface of a slot machine is considered very important. This is because the operation unit is a part that stands out in appearance and directly operated by game players.

Such a slot machine is marketed all around the word. Therefore, a display of the operation unit needs to correspond to a language of each country. Accordingly, a conventional operation unit has been arranged so that a top surface cover of a button can be detached by a tool like a driver. This arrangement has made it possible to insert a sheet corresponding to a language of each country under the top surface cover. However, detaching the top surface cover takes a lot of trouble and there has been a concern in causing a trouble such as damaging a button by the tool. Recently, a thin display device such as an LCD (liquid crystal display panel) or the like, where a display can be freely changed, is often used for the operation unit. For example, Patent Literature 1 discloses a slot machine including an operation unit provided with a touch panel in which a position input device is laminated on a thin display device. In such a slot machine, a character and/or a numeric keypad is displayed by use of the touch panel, and input of the number of bets and instruction to start a spin of reels can be made by use of the touch panel.

CITATION LIST

Patent Literatures

Patent Literature 1

Japanese Patent Application Publication, Tokukai, No. 2005-111137 (Publication Date: Apr. 28, 2005)

SUMMARY

However, in such a conventional arrangement, a game player touches only a screen. Accordingly, as compared to a push button type arrangement, the game player cannot have a sense of intuitively making an operation.

In a push button type arrangement, a game player sensuously sets the number of bets by making an operation to push down on a push button for the number of bets to be set. However, when setting the number of bets by an operation to touch the screen, a game player needs to check whether the number of bets is correctly set every time the game player touches the screen. This deteriorates a sense of making an operation, as compared to that in the push button type arrangement, and the game player cannot be given a sense of intuitively making an operation (for example, a sense of clicking). Further, the game player checks the number of bets every time the game player sets the number of bets. This makes the game player to take a longer time to play one game. This deteriorates a sense of playing a speedy game or a quick game.

One or more embodiments of the present invention provides an operation unit which is capable of giving a game player a sense of intuitively making an operation equivalent to a sense obtained by a push button type arrangement, though being an operation unit whose display can be freely changed; and a game machine including the operation unit.

An operation unit according to one or more embodiments of the present invention includes: a touch panel sensing a press; and a button plate provided above the touch panel, the button plate having a plurality of push buttons each protruding on a side opposite to a side where the touch panel is present, the button plate being provided along a surface of the touch panel and including (i) a base section having apertures at respective positions where the plurality of push buttons are formed, (ii) top surface sections each constituting corresponding one of the plurality of push buttons and serving as an operation surface, (iii) bending deformable sections each connecting, in a freely elastically deformable manner, a peripheral section of corresponding one of the top surface sections and an edge of corresponding one of the apertures formed in the base section, and (iv) projections provided on back sides of the top surface sections, one or more of the projections coming into contact with the surface of the touch panel at the time when any one of the top surface sections is pushed down toward the touch panel and corresponding one of the bending deformable sections is subjected to bending deformation, the one or more of the projections corresponding to the one top surface section pushed down.

An operation unit according to one or more embodiments of the present invention is capable of giving a game player a sense of intuitively making an operation equivalent to a sense obtained by a push button type arrangement, though being an operation unit whose display can be freely changed.

DETAILED DESCRIPTION

The following discusses embodiments of the present invention, with reference to attached drawings. However, the present invention is by no means limited the following embodiments but may be variously altered within the scope of the present invention. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention.

The operation unit according to one or more embodiments of the present invention can be used as a switch panel of, for example, various types of game machines, industrial equipment, or consumer equipment. Below is discussed an example where the operation unit according to one or more embodiments of the present invention is provided in a slot machine that is a game machine.

Figure 1:
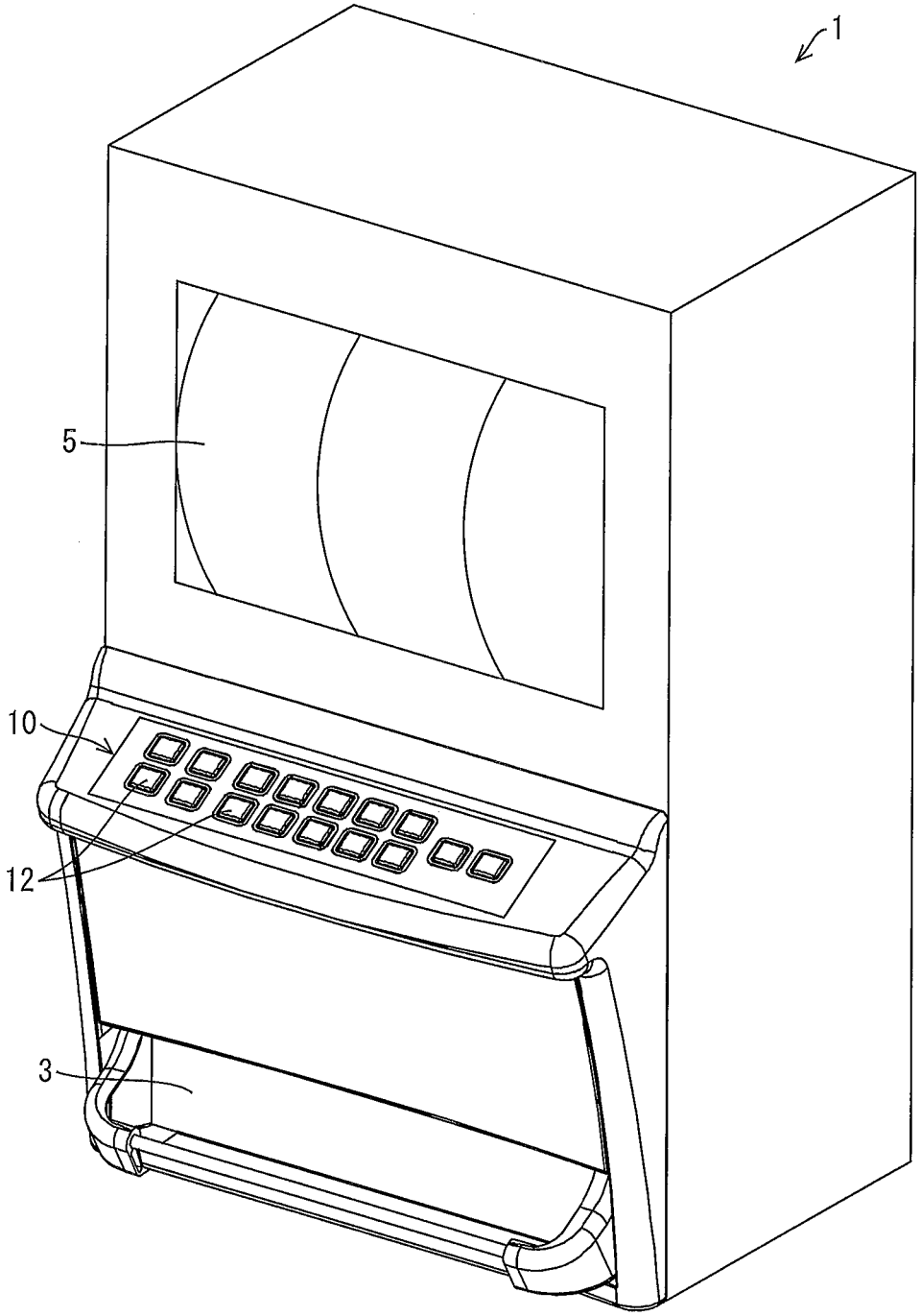
FIG. 1 is a perspective view of an overview of a slot machine including an operation unit according to one or more embodiments of the present invention.

FIG. 1 is a perspective view of an overview of a slot machine 1 including an operation unit 10. A slot machine 1 is provided with a reel section 5 in a center of a front surface that faces a game player (operator). The reel section 5 includes a plurality of reels (not illustrated) displaying a plurality of kinds of symbols. The plurality of reels start spinning in response to a game-player's push on a predetermined push button 12 for making an instruction to start a spin of the reels. The predetermined push button 12 is one of a plurality of push buttons 12 provided below the reel section 5. The plurality of reels automatically stop under machine control. When the reels stop, symbols are displayed in a window of the reel section 5. According to matching of the symbols and a kind of thus matched symbols, a prize is determined. The game player is given an award in accordance with the prize determined and the number of bets. The number of bets is inputted also by pushing down on a push button 12 provided in the operation unit 10. Provided below the operation unit 10 is a receiver tray 3 for receiving medals that are paid out in accordance with the prize.

Figure 2:
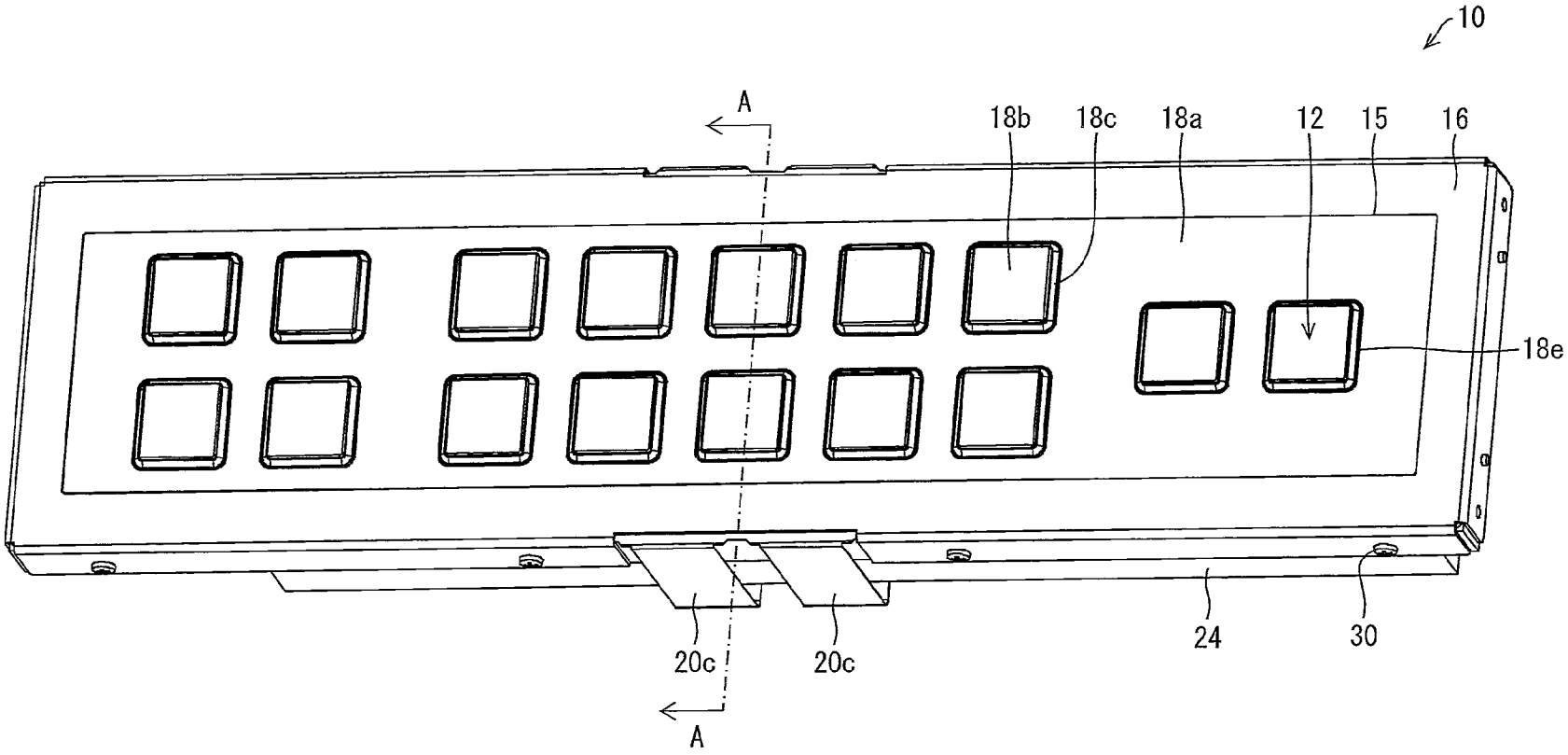
FIG. 2 is a perspective view illustrating an appearance of the operation unit.
Figure 3:
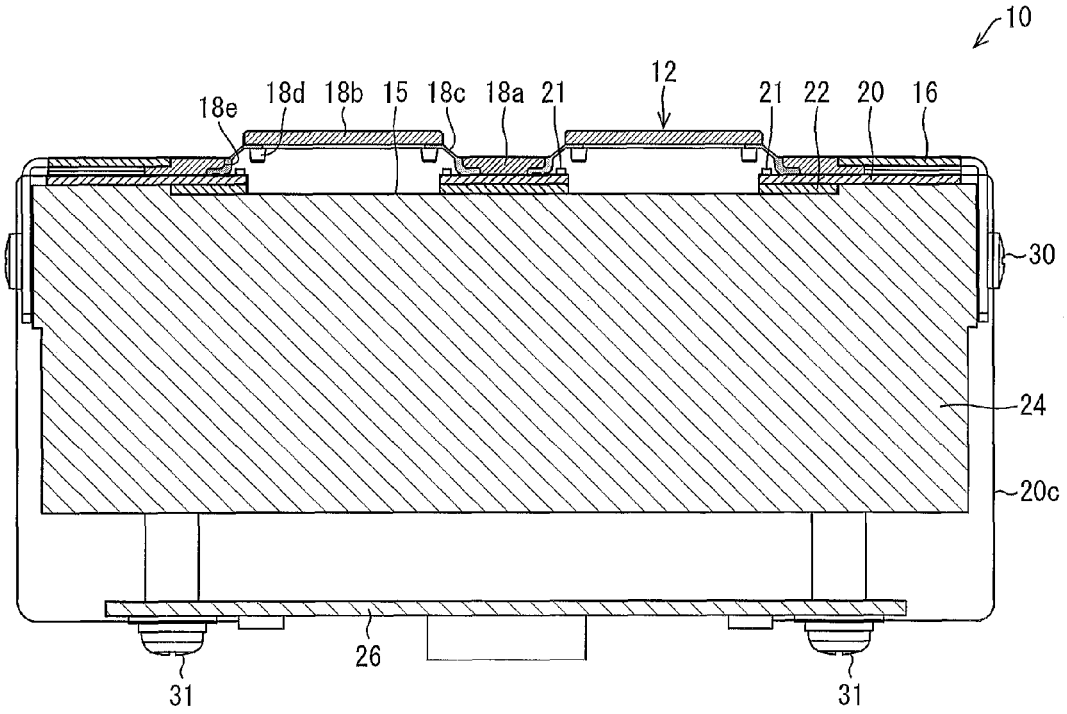
FIG. 3 is a cross sectional view of the operation unit.
Figure 4:
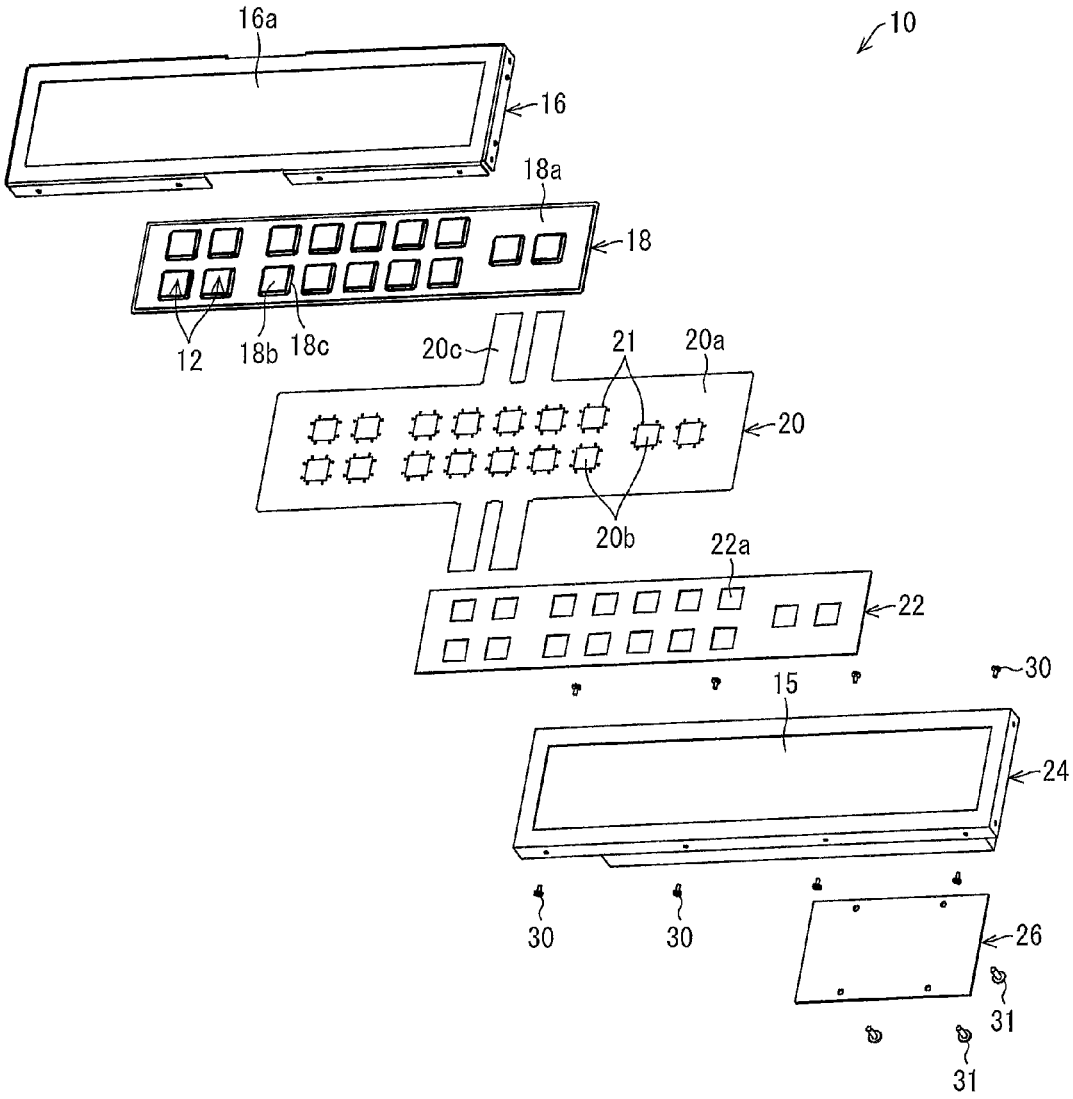
FIG. 4 is an exploded perspective view of the operation unit.

FIG. 2 is a perspective view illustrating an appearance of the operation unit 10. FIG. 3 is a cross sectional view of the operation unit 10, taken along line A-A of FIG. 2 in a direction of arrows. FIG. 4 is an exploded perspective view of the operation unit 10. As illustrated in FIG. 2, the operation unit 10 has a rectangular form. The operation unit 10 is arranged by providing a plurality of push buttons 12 along a longitudinal direction of the operation unit 10 so that the plurality of push buttons 12 overlap with a display area 15 of a touch panel 24.

As illustrated in FIGS. 3 and 4, the operation unit 10 is arranged to have a multi-layer in which a cover 16, a push button plate 18, and an LED substrate 20, a panel protection plate 22, the touch panel 24, and a control substrate 26 are laminated in this order from the top.

The cover 16 is a frame-like member that is made of thin metal such as aluminum. The cover 16 is provided with an opening 16*a* corresponding to the display area 15 of the touch panel 24. The cover 16 is fit on the touch panel 24 from above the touch panel 24 so that the push button plate 18, the LED substrate 20 and the panel protection plate 22 are sandwiched between the cover 16 and the touch panel 24. In this manner, the cover 16 is fixed with a screw 30 to a peripheral section of the touch panel 24.

The push button plate (button plate) 18 has optical transparency that makes a display of the touch panel 24 visible. The push button plate (button plate) 18 has a base section 18*a* having a shape corresponding to a shape of the display area 15 of the touch panel 24. To this base section 18*a*, the plurality of push buttons 12 are provided as if the plurality of push buttons 12 were made by press forming. The plurality of push buttons 12 are protruding on a side (i.e., the cover 16 side) opposite to the touch panel side. Note that the details of the push button plate 18 will be discussed later.

The LED substrate (element substrate) 20 is made of a thin transparent sheet like an OHP sheet. This LED substrate (element substrate) 20 has apertures 20*b* in an LED mounting section 20*a* having a shape corresponding to a shape of a top surface of the touch panel 24. The apertures 20*b* are formed so as to correspond to the plurality of push buttons 12 formed on the push button plate 18. The LED substrate 20 is also provided with a plurality of LEDs (solid light-emitting elements) 21 around each of the apertures 20*b*. The plurality of LEDs 21 are caused to light up or blink and used for carrying out a presentation of the slot machine 1. Further, on two sides along a longitudinal direction of the LED mounting section 20*a*, a line drawing section 20*c* is provided. The line drawing section 20*c* is for drawing, to the control substrate 26, lines (not illustrated) respectively connected with the LEDs 21.

The panel protection plate 22 is a transparent member for protecting the touch panel 24. This panel protection plate 22 has a shape corresponding to the shape of the display area 15 of the touch panel 24. The panel protection plate 22 also has apertures 22*a* corresponding to the plurality of push buttons 12 formed on the push button plate 18, in a similar manner to the LED substrate 20.

The touch panel 24 is provided by forming a multi-layer including a thin display device such as an LCD (liquid crystal display device) and a position input device. The touch panel 24 is required to sense a press on a surface of the touch panel 24. Accordingly, it is possible to employ, for example, a resistive film type touch panel for the touch panel 24.

The touch panel 24 is not only capable of displaying, in accordance with a language of each country where the slot machine 1 is used, instruction contents that can be inputted by pushing down on the push buttons 12, but also usable for a presentation of the slot machine 1 such as a display of information with use of an entire display area.

The control substrate 26 controls driving of the touch panel 24, and driving of the LEDs 21 mounted on the LED substrate 20. The control substrate 26 is fixed to a back side of the touch panel 24 by screws 31, in a manner such that a space between the control substrate 26 and the back side of the touch panel 24 is maintained (See FIG. 3).

Figure 5A:
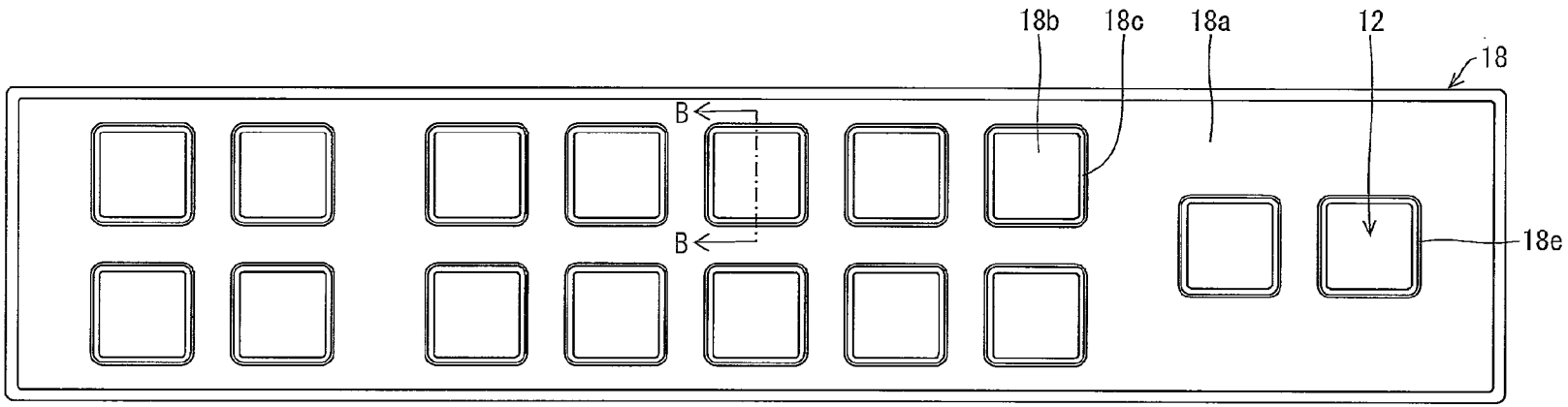
FIGS. 5(*a*)-5(*b*) are views illustrating an arrangement of a push button plate in the operation unit.
Figure 5B:
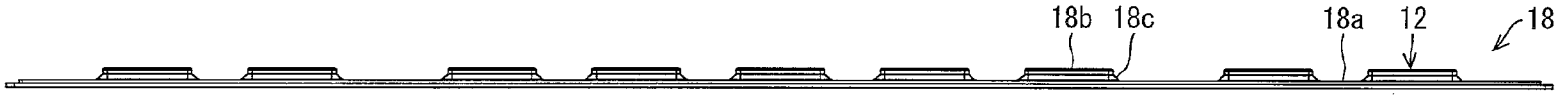
Figure 6:
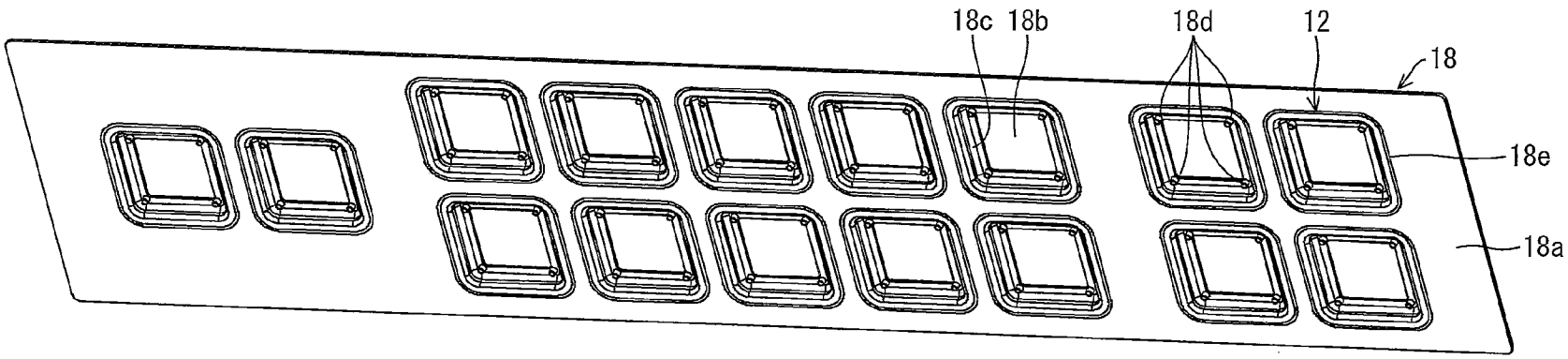
FIG. 6 is a back view of the push button plate.
Figure 7:
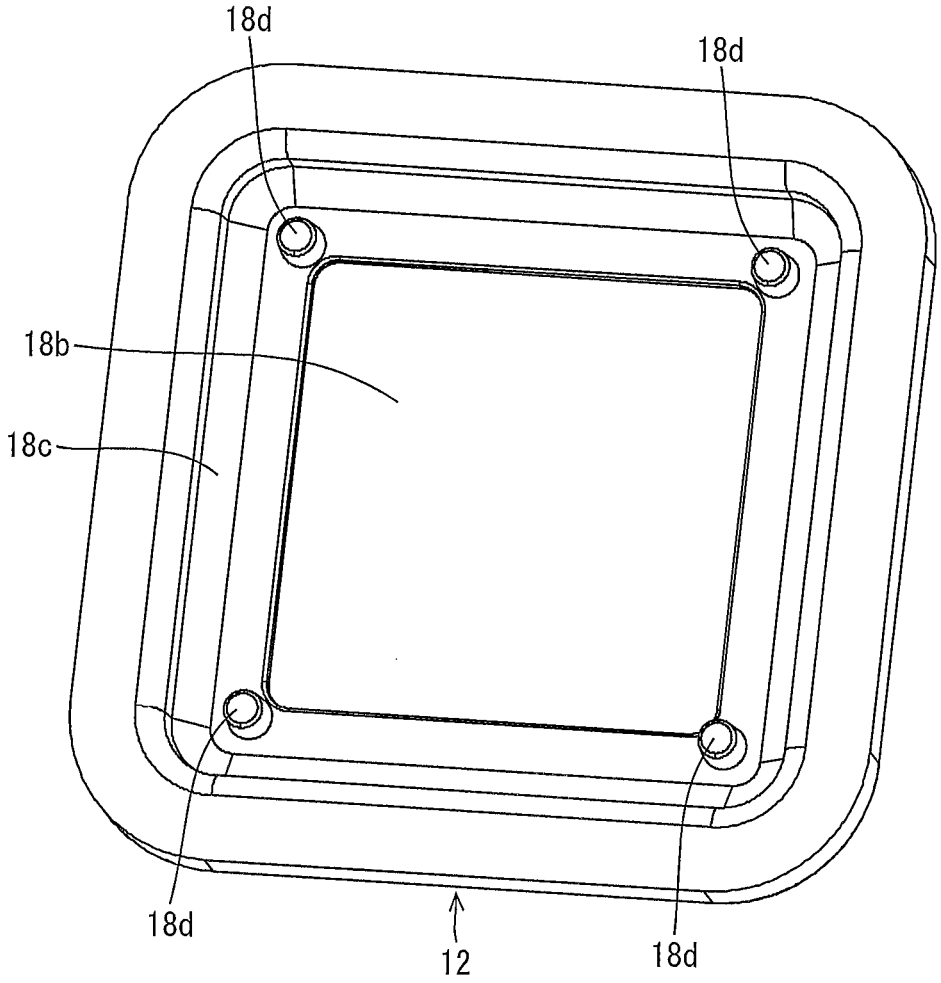
FIG. 7 is a detail back view of a push button section of the push button plate.
Figure 8:
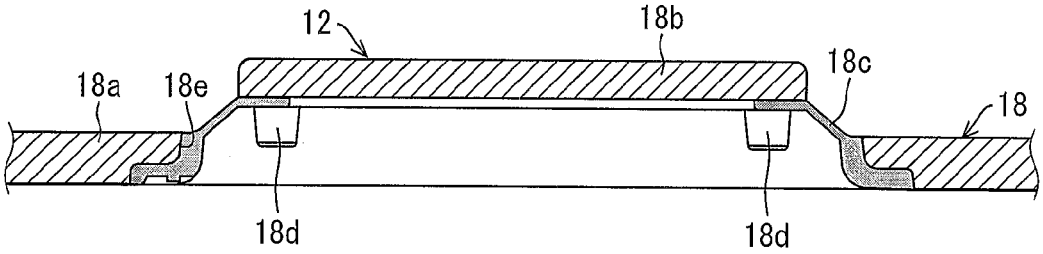
FIG. 8 is an enlarged cross-sectional view of the push button section of the push button plate.

Next, the following discusses an arrangement of the push button plate 18, with reference to FIGS. 5(*a*) to 9. FIGS. 5(*a*)-5(*b*) are views illustrating an arrangement of the push button plate 18. FIG. 5(*a*) is a plan view of the push button plate 18, while FIG. 5(*b*) is a front view of the push button plate 18. FIG. 6 is a back view of the push button plate 18. FIG. 7 is a detail back view of a push button 12 section of the push button plate 18. FIG. 8 is an enlarged cross-sectional view of the push button 12 section of the push button plate 18, taken along line B-B of FIG. 5(*a*) in a direction of arrows.

As illustrated in FIGS. 5(*a*)-5(*b*), in the push button plate 18, the plurality of push buttons 12 are provided to the base section 18*a* that is rectangular. The base section 18*a* has apertures 18*e* at positions where the push buttons 12 are formed.

The push buttons 12 each have an identical structure, and each include a top surface 18*b* that is substantially quadrangular, a bending deformable section 18*c* provided so as to surround the top surface section 18*b*, and projections (protrusions) 18*d* provided on a back side (bottom) of the top surface section 18*b* (See FIG. 7). Note that a shape of the top surface section 18*b* of each of the push buttons 12 is not limited to a substantially rectangular shape.

The top surface section 18*b* becomes an operation surface of a corresponding push button 12. The bending deformable section 18*c* connects, in a freely elastically deformable manner, a peripheral section of the top surface section 18*b* and an edge of a corresponding aperture 18*e* of the base section 18*a*. The bending deformable section 18*c* has a shape that stretches outward from the peripheral section of the top surface section 18*b* toward the base section 18*a*.

As illustrated in FIGS. 6 and 7, the projections 18*d* are provided to a back side (bottom) of the top surface section 18*b* in a manner such that the projections 18*d* are provided to four corners of the substantially rectangular shape of the top surface section 18*b*, respectively. As illustrated in FIG. 8, the projections 18*d* each have an end at a position that is higher than the back side (bottom) of the base section 18*a* when a corresponding push button 12 is not pushed down. The bending deformable section 18*c* is formed so that bending deformation of the bending deformable section 18*c* occurs at the time when the top surface section 18*b* is pushed down toward the touch panel 24, and thereby, the end of the projection 18*d* comes in contact with the surface of the touch panel 24.

Figure 9:
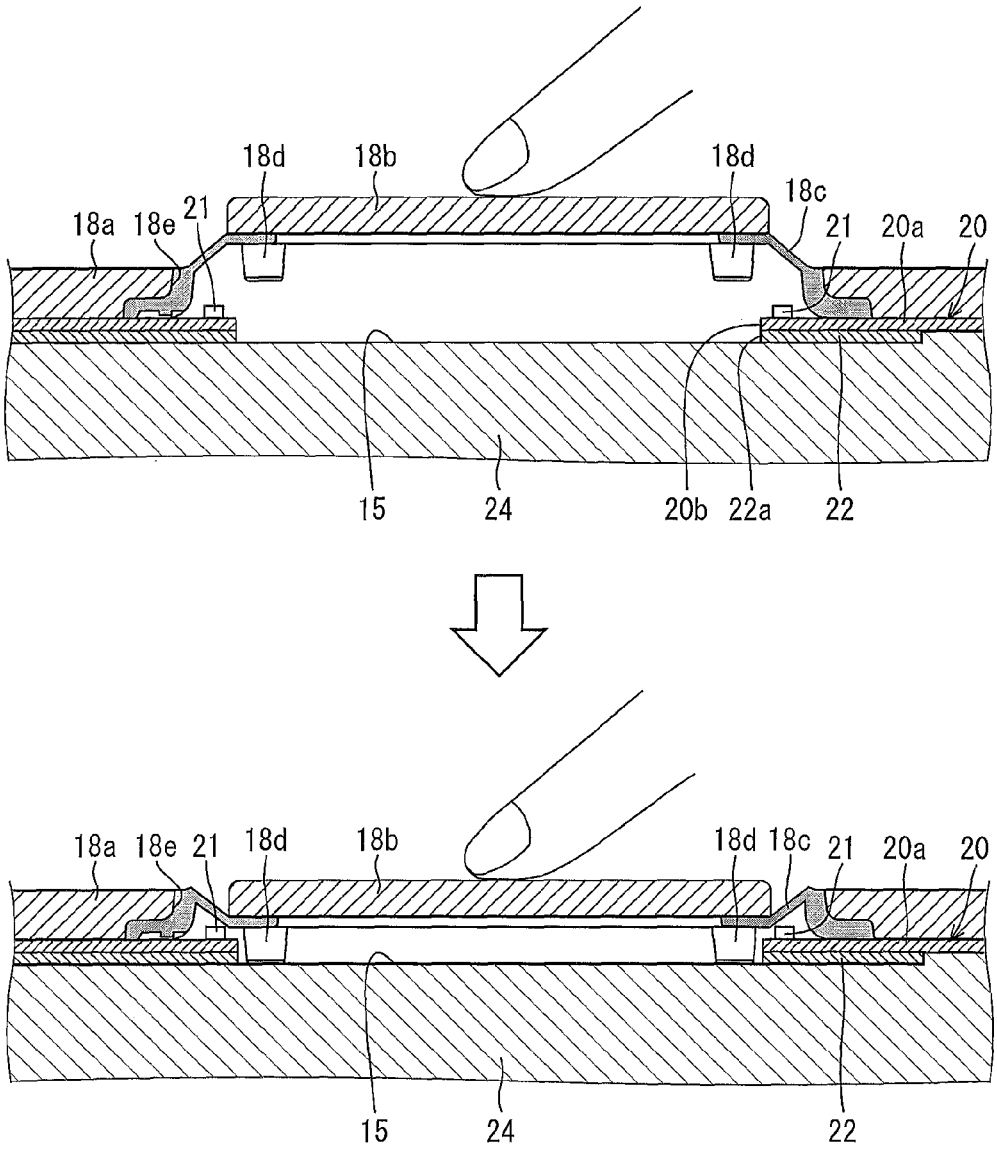
FIG. 9 is an explanatory view illustrating a state of a case where the push button of the operation unit is pushed down.

FIG. 9 is an explanatory view illustrating a state in a case where a push button 12 is pushed in the operation unit 10. As illustrated in FIG. 9, when a game player pushes down on a top surface section 18*b* of the push button toward the touch panel 24, bending deformation of a bending deformable section 18*c* of the push button 12 occurs. Then, projections 18*d* provided on a back side of the top surface section 18*b* comes in contact with the surface of the touch panel 24 through an aperture 20*b* provided in the LED substrate 20 and an aperture 22*a* provided in the panel protection plate 22.

According to the present embodiment, when at least one of four projections 18*d* provided to one push button 12 comes in contact with the touch panel 24, the control substrate 26 for processing an output from the touch panel 24 determines that the one push button 12 is pushed down.

A material of the top surface section 18*b* of the push button 12 and the base section 18*a* in such a push button plate 18 is required to have strength and rigidity to an extent that makes it possible to maintain a shape of the top surface section 18*b* and the base section 18*a* even when the top surface section 18*b* and the base section 18*a* are pushed down. The material is also required to have optical transparency that makes it possible to view a display of the touch panel provided below the push button plate 18. Accordingly, the material of the top surface section 18*b* and the base section 18*a* of the push button 12 can be a transparent resin such as PC (polycarbonate) resin or PMMA resin (acrylate resin).

Meanwhile, a material of the bending deformable section 18*c* is required to have elasticity that allows bending deformation of the bending deformable section 18*c* to occur in response to a pushing operation and also to restore a shape of the bending deformable section 18*c* to an original shape at the time when the pushing operation is released. The material of the bending deformable section 18*c* is also required to have optical transparency that allows transmission of light of the LEDs 21 of the LED substrate 20 provided below the push button plate 18 and that does not hamper visibility of a display of the touch panel 24. In the push button plate 18, an area occupied by the bending deformable section 18*c* is smaller than those of the top surface section 18*b* and the base section 18*a*, and has a frame shape whose width is small. Accordingly, the visibility of a display of the touch panel 24 is not hampered even when the bending deformable section 18*c* does not have optical transparency as high as optical transparency that the top surface section 18*b* and the base section 18*a* are required to have. Further, because light of the LEDs 21 has a higher luminance than light of the touch panel 24, the visibility of light of the LEDs 21 and light of the light guide plate 28 are also not hampered by the bending deformable section 18*c*. Such a material of the bending deformable section 18*c* can be, for example, a transparent elastomer.

Accordingly, in the present embodiment, the push button plate 18 is produced by, for example, two-color molding in which different materials are used. By producing the push button plate 18 by two-color molding, the top surface section 18*b*, the base section 18*a* and the bending deformable section 18*c* can be easily produced by using different materials one of which is for the bending deformable section 18*c* and the other one of which is for the top surface section 18*b* and the base section 18*a*.

The operation unit 10 having the above arrangement is capable of displaying, by use of the touch panel 24, various kinds of information. Such a display includes a display in a language of a country where the operation unit 10 is used. Further, the operation unit 10 is also capable of giving a game player a sense of intuitively making an operation, that is, a sense of pushing down on the push button 12. Therefore, it becomes not necessary to check, on a screen, set contents every time an operation is made. Further, a game player can also have a sense of playing a speedy game or a quick game equivalent to that obtained from a push button type arrangement.

Furthermore, the push button plate 18 including the push buttons 12 has a one-sheet arrangement. Accordingly, it is only necessary that the top surface section 18*b* and the base section 18*a* each have a thickness in accordance with a required strength and the bending deformable section 18*c* has a height that can give a game player a sense of intuitively making an operation, that is, a sense of pushing down on a push button. Therefore, the push button plate 18 can be arranged to be thin. This makes it possible to provide the top surface section 18*b* of the push button 12 at a position close to the surface of the touch panel 24. Accordingly, even when a game player views a display of the touch panel 24 via the top surface section 18*b*, the game player does not have a strange feeling that the display is far apart from the top surface section 18*b*. Consequently, the game player can have a natural sense of making an operation.

Further, in the operation unit 10, a whole of the push button plate 18 has optical transparency that allows viewing a display of the touch panel 24. Accordingly, though the push buttons 12 that can additionally give a sense of clicking are provided on a display surface of the touch panel 24, a visible area of the touch panel 24 is not decreased. This makes it possible to carry out information display or the like with use of a full display area of the touch panel 24.

In addition, in the operation unit 10, the LED substrate 20 is provided. Accordingly, it becomes possible to carry out a presentation by causing the LEDs 21 to light up in addition to a presentation by use of displays of the touch panel 24. This can further increase a presentation effect.

An operation unit according to one or more embodiments of the present invention includes: a touch panel sensing a press; and a button plate provided above the touch panel, the button plate having a plurality of push buttons each protruding on a side opposite to a side where the touch panel is present, the button plate being provided along a surface of the touch panel and including (i) a base section having apertures at respective positions where the plurality of push buttons are formed, (ii) top surface sections each constituting corresponding one of the plurality of push buttons and serving as an operation surface, (iii) bending deformable sections each connecting, in a freely elastically deformable manner, a peripheral section of corresponding one of the top surface sections and an edge of corresponding one of the apertures formed in the base section, and (iv) projections provided on back sides of the top surface sections, one or more of the projections coming into contact with the surface of the touch panel at the time when any one of the top surface sections is pushed down toward the touch panel and corresponding one of the bending deformable sections is subjected to bending deformation, the one or more of the projections corresponding to the one top surface section pushed down.

The operation unit having the above arrangement is capable of displaying, by use of the touch panel, various kinds of information. Such a display includes a display in a language of a country where the operation unit is used. Further, the operation unit is also capable of giving a game player a sense of intuitively making an operation, that is, a sense of pushing down on a push button. Therefore, it becomes not necessary to check, on a screen, set contents every time an operation is made. Further, a game player can also have a sense of playing a speedy game or a quick game equivalent to that obtained from a push button type arrangement.

Furthermore, the button plate including the push buttons has a one-sheet arrangement. Accordingly, it is only necessary that the top surface sections and the base section each have a thickness in accordance with a required strength and the bending deformable sections have a height that can give a game player a sense of intuitively making an operation, that is, a sense of pushing down on a push button. Therefore, the button plate as a whole can be arranged to be thin. This makes possible to provide the top surface sections at positions close to the surface of the touch panel. Accordingly, even when a game player views a display of the touch panel via the top surface sections of the push buttons, the game player does not have a strange feeling that the display is far apart from the top surface sections. Consequently, the game player can have a natural sense of making an operation.

Further, the operation unit according to one or more embodiments of the present invention is arranged such that the button plate has optical transparency that makes a display of the touch panel visible.

In the above arrangement, though the push buttons that can additionally give a sense of clicking are provided on a display surface of the touch panel, a visible area of the touch panel is not decreased. This makes it possible to carry out information display or the like with use of a full display area of the touch panel. This increases a presentation effect.

Further, the operation unit according to one or more embodiments of the present invention can be arranged such that the button plate is produced by two-color molding, with use of different materials one of which is for the bending deformable sections and the other one of which is for the base section and the top surface sections.

As described above, according to one or more embodiments of the present invention a material for the top surface sections and the base section is arranged to be different from a material for the bending deformable sections, because the top surface sections and the base section are different in function from the bending deformable sections. By producing the button plate by two-color molding, the button plate having the one-sheet arrangement can be easily produced.

Further, the operation unit according to one or more embodiments of the present invention can be arranged to further include an element substrate provided with a light-emitting element, between the touch panel and the button plate, the element substrate having optical transparency that makes a display of the touch panel visible, and having apertures at respective positions corresponding to the plurality of push buttons, the apertures being formed so as to allow passage of the projections provided to the plurality of push buttons.

In the above arrangement, it becomes possible to carry out a presentation by causing a solid light-emitting element, such as an LED, to light up, in addition to presentations by use of a display of the touch panel. This can further increase a presentation effect.

A game machine according to one or more embodiments of the present invention includes the operation unit according to one or more embodiments of the present invention.

The present invention is not limited to the description of the embodiments above, but may be altered as appropriate by a skilled person within the scope of the claims. That is, the present invention encompasses an embodiment based on a proper combination of technical means modified as appropriate within the scope of the claims.

One or more embodiments of the present invention can be suitably applied to game machines such as a slot machine, a poker game machine, a mah-jongg game machine, and a card game machine.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

REFERENCE SIGNS LIST

1 slot machine (game machine)
5 reel section
10 operation unit
12 push button
15 display area
16 cover
18 push button plate
18*a* base section
18*b* top surface section
18*c* bending deformable section
18*d* projection (protrusion)
18*e* aperture
20 LED substrate
20*b* aperture
21 LED
22 panel protection plate
22*a* aperture
24 touch panel
26 control substrate

The invention claimed is:

1. An operation unit comprising:

a touch panel that senses a press; and a button plate disposed above the touch panel, and having a plurality of push buttons, each of which protrudes on a side opposite to a side where the touch panel is disposed, wherein the button plate is provided along a surface of the touch panel, and comprises:

a base section comprising apertures at respective positions where the plurality of push buttons are formed, top surface sections, each of which constitutes corresponding one of the plurality of push buttons and serves as an operation surface, bending deformable sections, each of which connects to a peripheral section of corresponding one of the top surface sections and to an edge of corresponding one of the apertures formed in the base section in a freely elastically deformable manner, and projections disposed on back sides of the top surface sections, wherein one or more of the projections comes into contact with the surface of the touch panel at the time when any one of the top surface sections is pushed down toward the touch panel and corresponding one of the bending deformable sections is subjected to bending deformation, and wherein the one or more of the projections corresponds to the one top surface section pushed down.

2. The operation unit as set forth in claim 1, wherein the button plate has optical transparency that makes a display of the touch panel visible.

3. The operation unit as set forth in claim 1, wherein the button plate is produced by two-color molding, with use of different materials one of which is for the bending deformable sections and the other one of which is for the base section and the top surface sections.

4. A game machine comprising the operation unit as set forth in claim 1.

5. An operation unit comprising:

a touch panel that senses a press;

a button plate disposed above the touch panel, and having a plurality of push buttons, each of which protrudes on a side opposite to a side where the touch panel is disposed; and an element substrate comprising a light-emitting element, between the touch panel and the button plate, wherein the button plate is provided along a surface of the touch panel, and comprises:

a base section comprising apertures at respective positions where the plurality of push buttons are formed, top surface sections, each of which constitutes corresponding one of the plurality of push buttons and serves as an operation surface, bending deformable sections, each of which connects to a peripheral section of corresponding one of the top surface sections and to an edge of corresponding one of the apertures formed in the base section in a freely elastically deformable manner, and projections disposed on back sides of the top surface sections, wherein one or more of the projections comes into contact with the surface of the touch panel at the time when any one of the top surface sections is pushed down toward the touch panel and corresponding one of the bending deformable sections is subjected to bending deformation, wherein the one or more of the projections corresponds to the one top surface section pushed down, wherein the element substrate has optical transparency that makes a display of the touch panel visible, and having apertures at respective positions corresponding to the plurality of push buttons, and wherein the apertures of element substrate are formed so as to allow passage of the projections provided to the plurality of push buttons.

* * * * *